US008267180B2

(12) United States Patent
Tirado et al.

(10) Patent No.: US 8,267,180 B2
(45) Date of Patent: Sep. 18, 2012

(54) REMOTELY CONTROLLABLE VARIABLE FLOW CONTROL CONFIGURATION AND METHOD

(75) Inventors: Ricardo A. Tirado, Spring, TX (US); Priyesh Ranjan, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 296 days.

(21) Appl. No.: 12/497,123

(22) Filed: Jul. 2, 2009

(65) Prior Publication Data

US 2011/0000680 A1 Jan. 6, 2011

(51) Int. Cl.
*E21B 34/06* (2006.01)

(52) U.S. Cl. ..... 166/373; 166/386; 166/227; 137/625.3

(58) Field of Classification Search ..... 166/66.6, 166/66.7, 227, 386, 373; 137/625.3
See application file for complete search history.

(56) References Cited

U.S. PATENT DOCUMENTS

| | | | | |
|---|---|---|---|---|
| 3,469,591 | A | 9/1969 | Odendahl | |
| 3,980,135 | A | 9/1976 | Garrett | |
| 4,026,363 | A | 5/1977 | Yonker et al. | |
| 4,066,128 | A | 1/1978 | Davis et al. | |
| 4,357,952 | A | 11/1982 | Knecht | |
| 4,360,064 | A | 11/1982 | O'Connor, III et al. | |
| 4,441,558 | A | 4/1984 | Welch et al. | |
| 4,629,002 | A | 12/1986 | Pringle | |
| 4,790,378 | A | 12/1988 | Montgomery et al. | |
| 4,951,752 | A | 8/1990 | Coleman | |
| 4,962,815 | A | 10/1990 | Schultz et al. | |
| 4,976,314 | A | 12/1990 | Crawford et al. | |
| 5,018,575 | A | 5/1991 | Parsons | |
| 5,291,947 | A | 3/1994 | Stracke | |
| 5,297,634 | A | 3/1994 | Loughlin | |
| 5,743,497 | A | 4/1998 | Michael | |
| 5,803,119 | A | 9/1998 | Steinke | |
| 5,803,179 | A * | 9/1998 | Echols et al. | 166/370 |
| 5,896,928 | A | 4/1999 | Coon | |
| 6,112,817 | A | 9/2000 | Voll et al. | |
| 6,334,486 | B1 | 1/2002 | Carmody et al. | |
| 6,382,569 | B1 | 5/2002 | Schattner et al. | |
| 6,619,392 | B2 | 9/2003 | Marangoni et al. | |
| 6,644,412 | B2 * | 11/2003 | Bode et al. | 166/373 |
| 6,810,955 | B2 | 11/2004 | Roth et al. | |
| 6,883,610 | B2 | 4/2005 | Depiak | |
| 6,883,613 | B2 | 4/2005 | Bode et al. | |
| 7,222,676 | B2 | 5/2007 | Patel et al. | |

(Continued)

FOREIGN PATENT DOCUMENTS

| | | |
|---|---|---|
| WO | WO9905395 | 2/1999 |

OTHER PUBLICATIONS

International Search Report and Written Opinion; Date of Mailing Feb. 10, 2011; International Appln No.; PCT/US2010/039952; International Search Report 5 pages; Written Opinion 3 pages.

(Continued)

*Primary Examiner* — Daniel P Stephenson
*Assistant Examiner* — Richard Alker
(74) *Attorney, Agent, or Firm* — Cantor Colburn LLP

(57) ABSTRACT

A remotely controllable flow control configuration including a body; one or more flow restrictors disposed in the body; and a selector fluidly connected with the body and capable of supplying or denying fluid to one or more of the one or more flow restrictors and method.

14 Claims, 4 Drawing Sheets

U.S. PATENT DOCUMENTS

| | | | | |
|---|---|---|---|---|
| 7,255,178 | B2 | 8/2007 | Slup et al. | |
| 7,261,155 | B1 | 8/2007 | Ward et al. | |
| 7,273,106 | B2 | 9/2007 | Huckabee et al. | |
| 7,387,165 | B2 | 6/2008 | Lopez de Cardenas et al. | |
| 2001/0040033 | A1 | 11/2001 | Schnatzmeyer et al. | |
| 2002/0020534 | A1 | 2/2002 | Wilson et al. | |
| 2007/0163774 | A1* | 7/2007 | Hosatte et al. | 166/66.6 |
| 2007/0181312 | A1 | 8/2007 | Kritzler et al. | |
| 2008/0035350 | A1 | 2/2008 | Henriksen et al. | |
| 2008/0041581 | A1 | 2/2008 | Richards | |
| 2008/0047703 | A1 | 2/2008 | Stoesz et al. | |
| 2008/0190608 | A1 | 8/2008 | Coronado et al. | |
| 2008/0283238 | A1 | 11/2008 | Richards et al. | |
| 2009/0008078 | A1 | 1/2009 | Patel | |
| 2009/0095468 | A1 | 4/2009 | Augustine et al. | |
| 2009/0120647 | A1 | 5/2009 | Turick et al. | |
| 2011/0000660 | A1 | 1/2011 | Joseph et al. | |
| 2011/0000679 | A1 | 1/2011 | Joseph et al. | |

OTHER PUBLICATIONS

International Search Report and Written Opinion, Mailed Feb. 10, 2011; International Appln No. PCT/US2010/039968; International Search Report 5 pages; Written Opinion 3 pages.

International Search Report and Written Opinion; Date of Mailing Feb. 10, 2011; International Apln No. PCT/US2010/039957; International Search Report 5 pages; Written Opinion 4 pages.

International Search Reportand Written Opinion; Date of Mailing Feb. 7, 2011; International Appln No. PCT/US2010/039479, International Search Report 5 pages; Written Opinion 4 pages.

International Search Report; PCT/US2010/039611; Korean Intellectual Property Office; Mailed Feb. 8, 2011.

International Search Report; PCT/US2010/039946; Korean Intellectual Property Office; Mailed Feb. 8, 2011.

Baker Oil Tools "Waterflood Regulators" Flow Control Catalog, Waterflood Regulators/Accessories, p. 78, Baker Oil Tools, Jul. 2004.

Brian Champion "A New Wireless Solution to Real Time Reservoir Surveillance and In-flow Control-Applications of Interest for Underground Gas Storage" for presentation at the 9th Annual Global Gas Village Summit (Europe), Milan, Italy Apr. 14-16, 2009, Expro 2009, pp. 1-24.

International Search Report and Written Opinion, Mailed May 9, 2011, International Appln. No. PCT/US2010/050533, Written Opinion 4 pages, International Search Report 5 pages.

Gai, H., "Requirements of Downhole Flow Control Valve," SPE Annual Technical Conference and Exhibition, Denver, Colorado, Oct. 5-8, 2003. SPE Paper No. 84323-MS.

Cyvas, M.K., et al. "Subsea Adjustable Choke Valves: A Focus on a Critical Component," SPE Production Engineering, vol. 4, No. 3, Aug. 1989, pp. 301-208. SPE Paper No. 16609-PA.

Winkler, H.W., et al., "Dynamic Performance Testing of Single-Element Unbalances Gas-Life Valves," SPE Production Engineering, vol. 2, No. 3, Aug. 1987, pp. 183-190. SPE Paper No. 14348-PA.

Kelkouli, Redha, et al., "Case Study in Water Shutoff Fluid Placement Using Straddled Through-Tubing Inflatable-Packers Technique," SPE Middle East Oil and Gas Show and Conference, Kingdom of Bahrain, Mar. 11-14, 2008. SPE Paper No. 104755-MS.

Blount, C.G., et al., "Inflatable CT Conveyed Selective Well Testing System for Logging Openhole and Horizontal Wellbored: Development and Use," SPE/IcoTA Coiled Tubing Conference and Exhibition, Houston, Texas, Apr. 8-9, 2003. SPE No. 81718-MS.

* cited by examiner

REMOTELY CONTROLLABLE VARIABLE FLOW CONTROL CONFIGURATION AND METHOD

CROSS REFERENCE TO RELATED APPLICATIONS

This application contains subject matter related to the subject matter of co-pending applications, which are assigned to the same assignee as this application, Baker Hughes Incorporated of Houston, Tex. The below listed applications are hereby incorporated by reference in their entirety:

U.S. patent application Ser. No. 12/497,158, entitled REMOTELY CONTROLLABLE MANIFOLD filed Jul. 2, 2009.

BACKGROUND

In fluid flowing systems, balance of a profile of fluid flow may be necessary in order to optimize the system. One example of such is in the downhole drilling and completion industry where fluids flowing into or out of a borehole, from or to a subterranean formation are subject to fingering due to varying permeability of the formation and frictional pressure drops. Controlling flow profiles that have traditionally been attempted using such devices are known in the art as inflow control devices. These devices work well for their intended use but are fixed tools that must be positioned in the completion as built and to be changed requires removal of the completion. As is familiar to one of ordinary skill in the art, this type of operation is expensive. Failure to correct profiles, however, is also costly in that for production wells that finger, undesirable fluid production is experienced and for injection wells, injection fluids can be lost to the formation. For other types of borehole systems, efficiency in operation is also lacking. For the foregoing reasons, the art would well receive a flow control configuration that alleviates the inefficiencies of current systems.

SUMMARY

A remotely controllable flow control configuration including a body; one or more flow restrictors disposed in the body; and a selector fluidly connected with the body and capable of supplying or denying fluid to one or more of the one or more flow restrictors.

A remotely controllable flow control configuration including a body; one or more flow restrictors disposed in the body; an individual channel fluidly connected with each flow restrictor of the one or more flow restrictors; and a selector fluidly connected with the body and capable of supplying or denying fluid to a selected channel.

A method for remotely controlling flow downhole including initiating a signal at a remote location to actuate a flow control configuration, a remotely controllable flow control configuration including a body; one or more flow restrictors disposed in the body; and a selector fluidly connected with the body and capable of supplying or denying fluid to one or more of the one or more flow restrictors; and modifying a flow profile in response to adjusting the configuration.

A method for remotely controlling flow downhole including initiating a signal at a remote location to actuate a flow control configuration, a remotely controllable flow control configuration including a body; one or more flow restrictors disposed in the body; an individual channel fluidly connected with each flow restrictor of the one or more flow restrictors; and a selector fluidly connected with the body and capable of supplying or denying fluid to a selected channel; and modifying a flow profile in response to adjusting the configuration.

BRIEF DESCRIPTION OF THE DRAWINGS

Referring now to the drawings wherein like elements are numbered alike in the several Figures.

DETAILED DESCRIPTION

Figure 1:
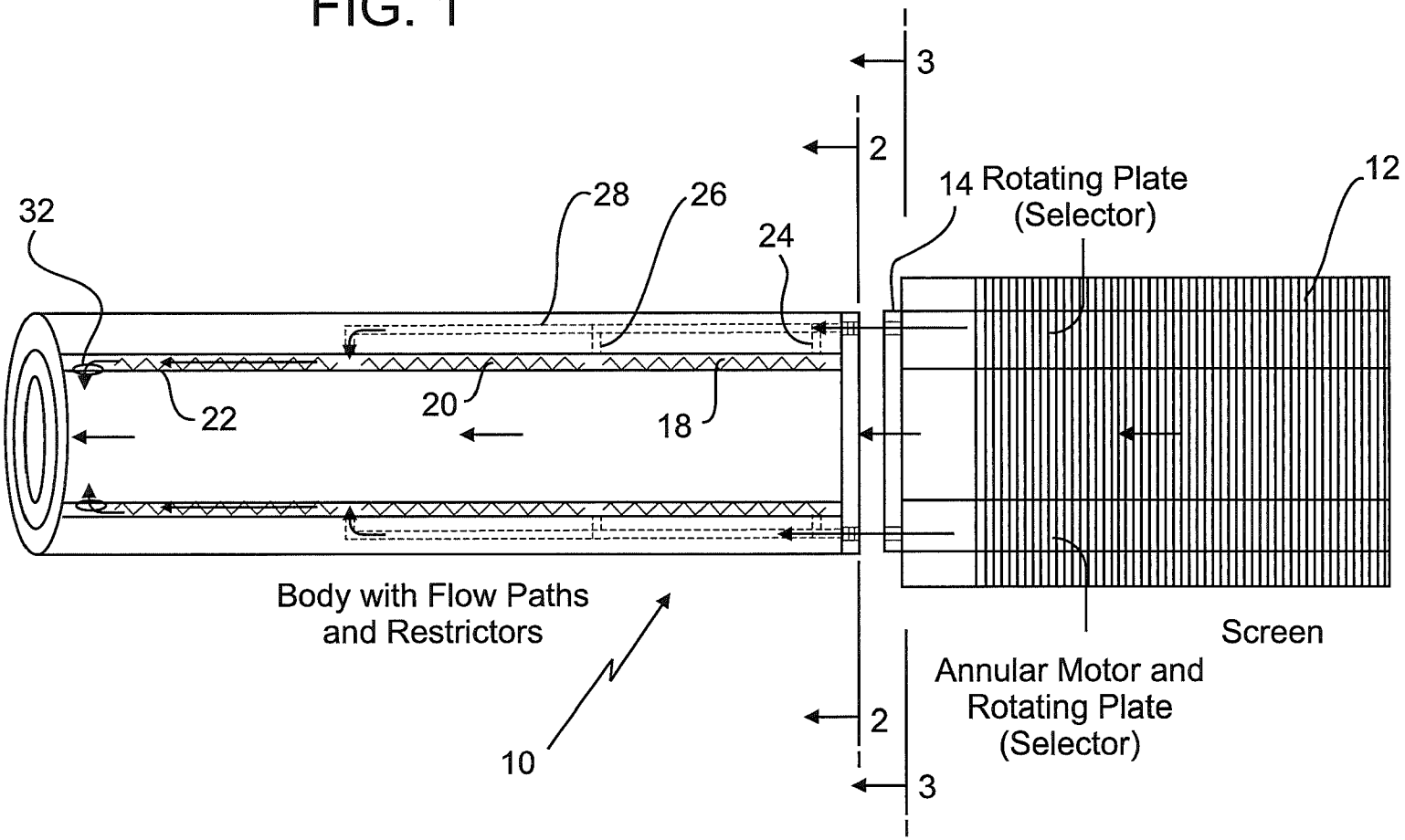
FIG. 1 is a schematic axial section view of a remotely controllable variable inflow control configuration as disclosed herein.
Figure 2:
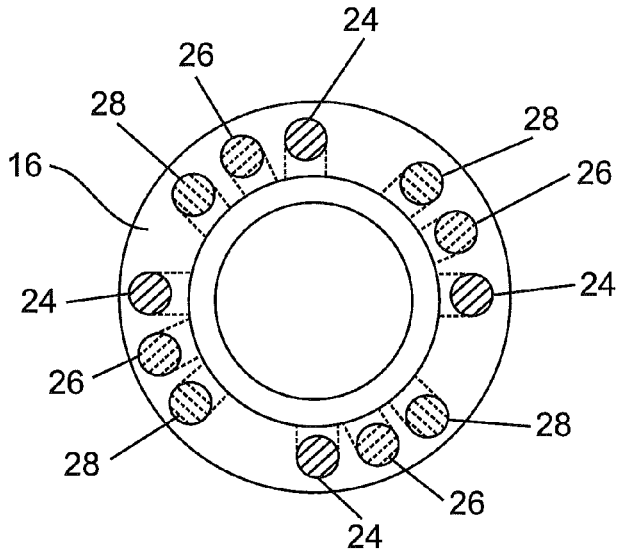
FIG. 2 is an axial view of the embodiment illustrated in FIG. 1 taken along section line 2-2 in FIG. 1.
Figure 3:
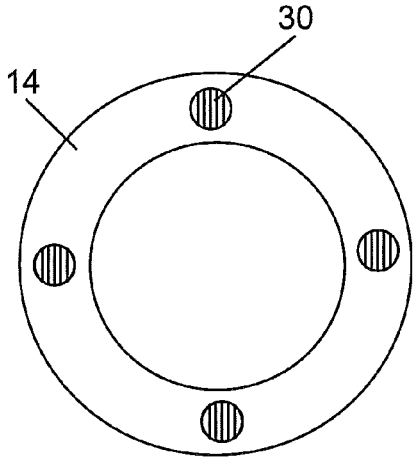
FIG. 3 is an axial view of the embodiment illustrated in FIG. 1 taken along section line 3-3 in FIG. 1.

Referring to FIG. 1, a configuration 10 is schematically illustrated to include a screen section 12, a selector 14 and a body 16 having one or more flow restrictors 18, 20, 22 (for example; no limitation intended) disposed in seriatim. The body further includes a number of flow channels 24, 26, 28 (again for example; no limitation intended)) that in one embodiment occur in sets about the body 16 as illustrated. It is to be understood that the number of restrictors need only be a plurality (this embodiment type) for variability in function as taught herein and need only be one if the adjustability is simply on or off. There is no upper limit to the number of restrictors that may be employed other than practicality with respect to available space and length of the tool desired or reasonably possible given formation length, etc. The number of flow channels in each set of flow channels represented will match the number of restrictors for reasons that will become clearer hereunder. The number of sets of flow channels however will be dictated by the available space in the body 16 and the relative importance to avoid a pressure drop associated with the number of channels as opposed to that facilitated by the restrictors 18, 20, 22 themselves. Generally, it will be undesirable to have additional flow restriction, causing a pressure drop, at the interface of the channels or at the selector 14. This is mediated by the cross sectional dimension of the channels and the cross sectional dimension of selector ports 30 as well as the actual number of sets of channels and the actual number of selector ports 30 aligned with channels. Stated alternately, the selector ports 30 can affect flow in two ways that are relevant to the invention. These are in the size of the opening representing each port 30 and the number of ports 30. Because it is desirable to avoid flow restriction in this portion of the configuration, the greater the size and number of ports 30 the better. This is limited by available annular space as can be seen in FIG. 3 but more so by the number of channels in each set of channels (that take up significantly more space in the annular area of the body 16) as can be seen in FIG. 2. Because the number of channels can reduce the number of sets of channels that can be employed and the embodiment discussed uses only one port per set of channels. Accordingly the number of ports possible in this embodiment is limited more by the number of channels than it is by the annular area of the selector itself The reason there is a plurality of channels in each set of channels for a particular configuration and a plurality of restrictors for that same particular configuration is to present a number of selectable pathways (associated with each channel) for fluid flow that will be directed (in the illustrated embodiment): 1) through all of the plurality of restrictors; 2) through some of the plurality of restrictors; or 3) through one of the plurality of restrictors. Further, it is noted that each restrictor of the plurality of restrictors may have its own pressure drop thereacross or the same pressure drop thereacross. They may all be the same, some of them may be the same and others different, or all may be different. Any combination of pressure drops among each of the plurality of flow restrictors in a given configuration is contemplated.

Referring directly to FIG. 1, there is a pathway created that includes restrictors 18, 20 and 22. That pathway is associated with channel 24. Where fluid is directed to channel 24, the pressure drop for that fluid will be the sum of pressure drops for the plurality of restrictors presented, in this case three (each of 18, 20 and 22). Where fluid is directed alternatively to channel 26, the fluid bypasses restrictor 18 and will be restricted only by whatever number of restrictors are still in the path of that fluid, in this case restrictors 20 and 22. In this case the pressure drop for fluid flowing in channel 26 will be the sum of pressure drops from restrictors 20 and 22. Where fluid is directed to channel 28, both restrictors 18 and 20 are bypassed and the only restrictor in the pathway is restrictor 22. In this position, the pressure drop is only that associated with restrictor 22. In each statement made, other pressure dropping properties such as friction in the system are being ignored for the sake of simplicity of discussion. Therefore for a downhole system in which this configuration is used, the pressure drop can be adjusted by selecting channel 24, 26 or 28 as noted. These can be selected at any time from a remote location and hence the configuration provides variability in flow control downhole and in situ.

In addition to the foregoing, in this particular embodiment or in others with even more restrictors arranged in seriatim, another level of restriction is possible. It should be appreciable by a reader having understood the foregoing description that in the illustrated embodiment, since there is annular room in the body 16 as illustrated for another channel, that is not shown but could be created between channels 28 and 24, another level of restriction or pressure drop can be obtained within the same illustrated embodiment. This is by bypassing all of the restrictors 18, 20, 22. This would present effectively no pressure drop due to flow restrictors in the flow pathway since all of them will have been bypassed. In each case the final entry of the fluid into the inside dimension of the configuration is through orifices 32. As should be evident from the foregoing, the configuration provides a number of remotely selectable pressure drops depending upon which channel is selected or the remote ability to shut off flow by misaligning the selector ports with the flow channels, in one embodiment.

Figure 4:
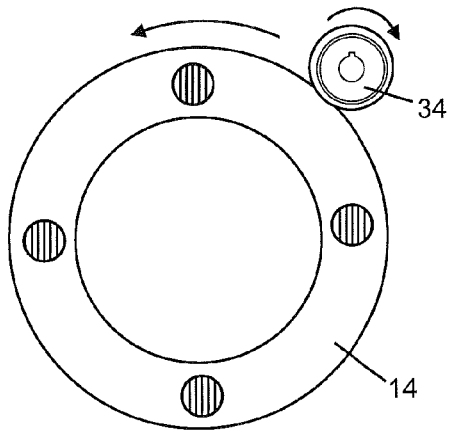
FIG. 4 is a schematic illustration of the selector disclosed herein with an alternate motor drive configuration.

The selection capability is provided by selector 14. As was noted earlier, in one embodiment the selector will have a number of ports 30 that matches the number of sets of channels such that it is possible to align each one of the ports 30 with the same type of channel in each set of channels. For example, in the illustrated embodiment of FIG. 3, the selector includes four ports 30 and the body 16 in FIG. 2 includes four sets of channels 24, 26, 28. When the selector is aligned such that one of the ports 30 aligns with, for example, channel 24, each of the other ports 30 will align with the channel 24 of another set of the channels 24, 26, 28. In so doing, the configuration 10 is set to produce a particular pressure drop using the selected number of restrictors 18, 20, 22 associated with a particular channel for each set of channels. Selection is facilitated remotely by configuring the selector 14 with a motor that is electrically or similarly actuated and hence can be commanded from a remote location, including a surface location. The motor may be of annular configuration, such motors being well known in the art, or may be a motor 34 offset from the selector such as that illustrated in FIG. 4. It will be appreciated that the interconnection of the motor 34 with the selector 14 may be of any suitable structure including but not limited to spur and ring gears, friction drive, belt drive, etc.

The configuration 10 possesses the capability of being reactive, not on its own, but with command from a remote source, to change the pressure drop as needed to optimize flow profiles either into or out of the borehole. It is important to note that while the terms "inflow control" have sometimes been used in connection with the configuration disclosed herein, "outflow" is equally controllable to modify an injection profile with this configuration.

Figure 5:
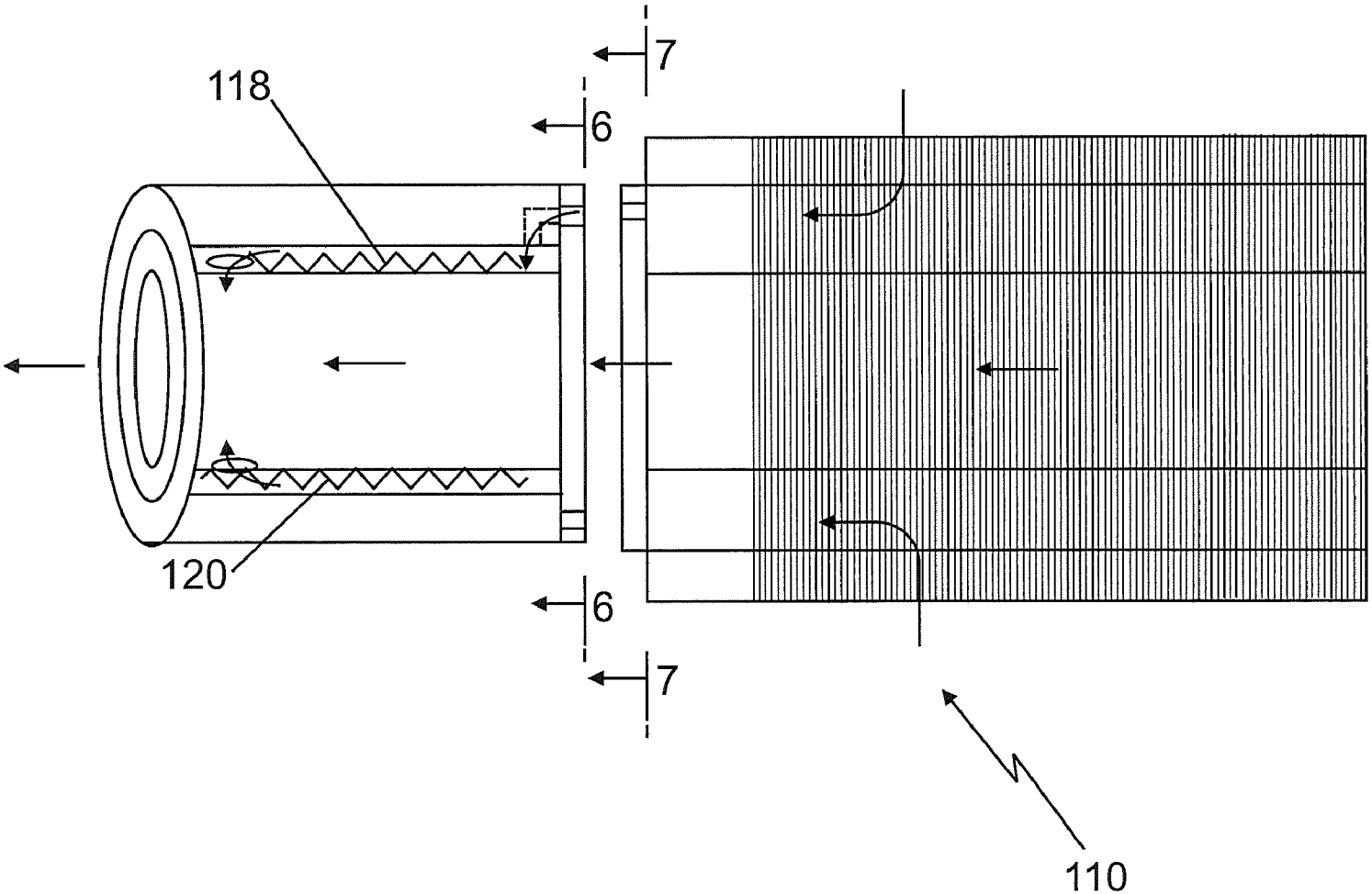
FIG. 5 is a schematic axial section view of an alternate embodiment of a remotely controllable variable inflow control configuration as disclosed herein.
Figure 6:
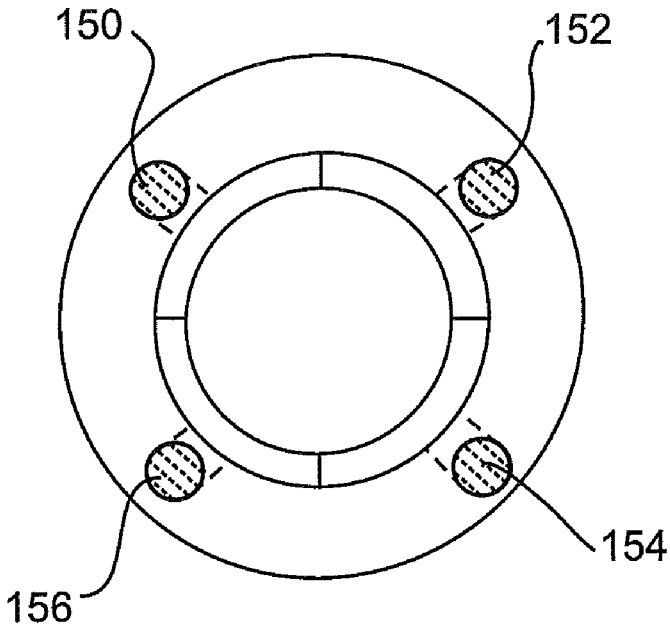
FIG. 6 is an axial view of the embodiment illustrated in FIG. 5 taken along section line 6-6 in FIG. 5.
Figure 7:
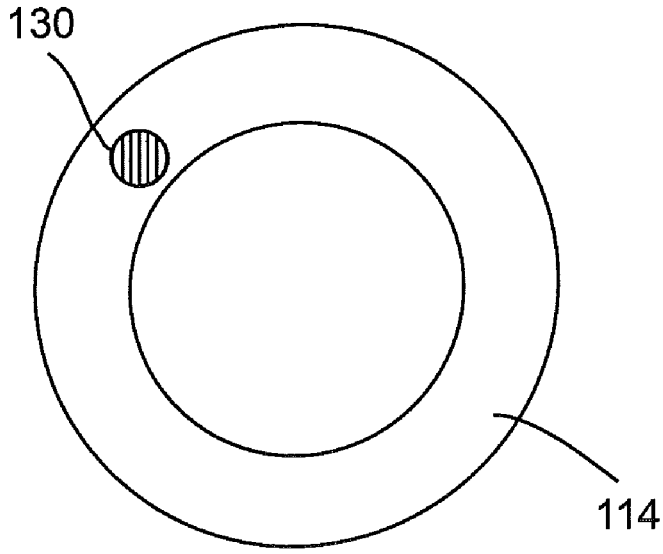
FIG. 7 is an axial view of the embodiment illustrated in FIG. 5 taken along section line 7-7 in FIG. 5.

In an alternate embodiment, configuration 110, referring to FIGS. 5, 6 and 7, a maze-type restrictor arrangement whose restrictor operability is known to the art from a similar commercial product known as EQUALIZER MAZE™ is employed. This type of flow restrictor provides restricted axial flow openings followed by perimetrical flows paths followed by restricted axial openings, which sequence may be repeated a number of times. In accordance with the teaching hereof, these types of restrictors are configured in quadrants or thirds or halves of the body 116 and could be configured as fifths, etc. limited only by practicality and available space. In current commercial embodiments of maze-type restrictors, each maze is of the same pressure drop and all function together. In the embodiment disclosed herein however, the restrictors, for example four, are each distinct from the other. This would provide four different pressure drops in a quadrant based maze-type system, three different pressure drops for a triad based maze-type system, two different pressure drops for a half based maze-type system, etc. It is to be understood however that all of the restrictors need not be different from all the others in a particular iteration. Rather each combination of possibilities is contemplated. Referring to FIG. 6, there are illustrated four channels 150, 152, 154, 156, each of which is associated with one restrictor. As illustrated in FIG. 5, restrictors 118 and 120 can be seen, the other two being above the paper containing the view and behind the plane of the paper containing the view, respectively. The selector 114 of the illustrated embodiment, FIG. 6, includes just one port 130 that can be manipulated via a motor similar to the motor possibilities discussed above to align the one port 130 with one of the channels 150, 152, 154, 156. By so doing, a selected pressure drop is available by command from a remote location including from a surface location (note such remote actuation is contemplated for each iteration of the invention). The embodiment is useful in that it allows for a more compact structure overall since each different pressure drop restrictor exists in the same longitudinal section of body rather than requiring a seriatim configuration that causes the body to be longer to accommodate the daisy-chained restrictors.

It is further noted that the embodiment of FIGS. 5-7 can be modified to provide additional possible flow restriction than just each of the restrictors individually. By providing more ports 130 in the selector 114, one or more of the channels 150, 152, 154, 156 can be selected and the average pressure drop of the number of restrictors implicated will prevail for the configuration. It will be appreciated that with consideration of available space, different combinations of restrictors in this embodiment can be selected through rotation of the selector 114.

While preferred embodiments have been shown and described, modifications and substitutions may be made thereto without departing from the spirit and scope of the invention. Accordingly, it is to be understood that the present invention has been described by way of illustrations and not limitation.

The invention claimed is:

1. A remotely controllable flow control configuration comprising:

a body;

a plurality of flow restrictors disposed in series in the body; and a selector fluidly connected with a plurality of channels each extending from the selector, the plurality of channels intersecting the plurality of flow restrictors at different locations in the body for selectively supplying or denying fluid to selected ones or selected portions of the flow restrictors.

2. A remotely controllable flow control configuration as claimed in claim 1, wherein the plurality of channels is arranged in a plurality of channel sets in the body, each channel set intersecting the plurality of flow restrictors at the different locations.

3. A remotely controllable flow control configuration as claimed in claim 2 wherein each channel set includes three channels extending from one end of the body to three different outlet locations in the body.

4. A remotely controllable flow control configuration as claimed in claim 3 wherein the outlet locations are between respective ones of the plurality of restrictors.

5. A remotely controllable flow control configuration as claimed in claim 2 wherein the selector includes a number of ports corresponding to a number of the channel sets in the body.

6. A remotely controllable flow control configuration as claimed in claim 5 wherein the number of ports is four.

7. A remotely controllable flow control configuration as claimed in claim 1 wherein each of the plurality of flow restrictors each has the same pressure drop thereacross.

8. A remotely controllable flow control configuration as claimed in claim 1 wherein each of the plurality of flow restrictors each has a unique pressure drop thereacross.

9. A remotely controllable flow control configuration as claimed in claim 1 wherein each of the plurality of flow restrictors each has one of the same pressure drop as the other of the plurality of flow restrictors or a different pressure drop than the others of the plurality of flow restrictors thereacross.

10. A remotely controllable flow control configuration as claimed in claim 1 wherein the selector is rotationally moveable relative to the body.

11. A remotely controllable flow control configuration as claimed in claim 1 wherein the selector is motor driven.

12. A remotely controllable flow control configuration as claimed in claim 1, wherein the locations are between respective ones of the one or more flow restrictors.

13. A method for remotely controlling flow downhole comprising:

initiating a signal at a remote location to actuate a flow control configuration as claimed in claim 1; and modifying a flow profile in response to adjusting the configuration.

14. A remotely controllable flow control configuration comprising:

a body;

a plurality of flow restrictors disposed in the body;

a plurality of channels fluidly connected to the plurality of flow restrictors, each channel associated with a different one of the flow restrictors; and a selector having one or more openings, the selector actuatable to align the one or more openings with selected ones of the channels for selectively supplying or denying fluid to the selected ones of the channels, each channel extending between its associated different one of the flow restrictors and the selector for selectively supplying or denying the fluid to associated ones or portions of the flow restrictors by intersecting the plurality of flow restrictors at different locations.

* * * * *